United States Patent [19]

Jaworowicz et al.

[11] Patent Number: 4,629,939

[45] Date of Patent: Dec. 16, 1986

[54] DISCHARGE LAMP WITH AUTOMATIC SHUT OFF

[75] Inventors: Stephen W. Jaworowicz, Horseheads, N.Y.; John F. Hall, Nutley, N.J.

[73] Assignee: North American Philips Lighting Corporation, New York, N.Y.

[21] Appl. No.: 684,519

[22] Filed: Dec. 21, 1984

[51] Int. Cl.[4] ..... H01J 7/44

[52] U.S. Cl. ..... 315/73; 315/74; 337/290

[58] Field of Search ..... 315/73, 74; 337/290

[56] References Cited

U.S. PATENT DOCUMENTS

| | | | |
|---|---|---|---|
| 460,140 | 9/1891 | Howell | 337/290 |
| 471,302 | 3/1892 | Marx | 337/290 |
| 4,013,920 | 3/1977 | Petro | 315/73 |
| 4,208,614 | 6/1980 | Strauss et al. | 315/74 |
| 4,305,020 | 12/1981 | Nalepa | 315/73 |
| 4,388,557 | 6/1983 | Shaffer | 315/74 |

*Primary Examiner*—Harold Dixon

*Attorney, Agent, or Firm*—Robert T. Mayer

[57] ABSTRACT

A high intensity discharge lamp with a safety switch which automatically shuts off the lamp upon rupture of the outer envelope. The switch is formed by a carbon rod disposed in the interior space between the arc tube and the outer envelope and connected in series with one of the electrodes so that the current flow through the rod maintains it at an elevated temperature during operation of the lamp. Upon rupture of the outer envelope, the carbon rod oxidizes and falls, thereby interrupting the electrical path to the electrodes.

11 Claims, 2 Drawing Figures

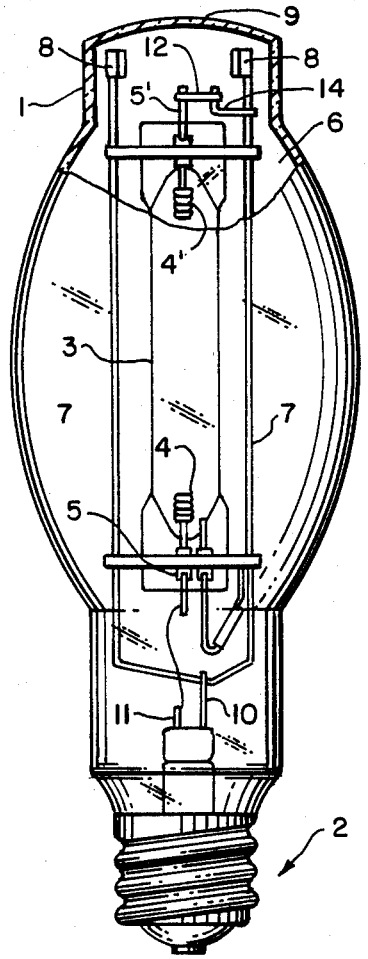
FIG.1
FIG.2
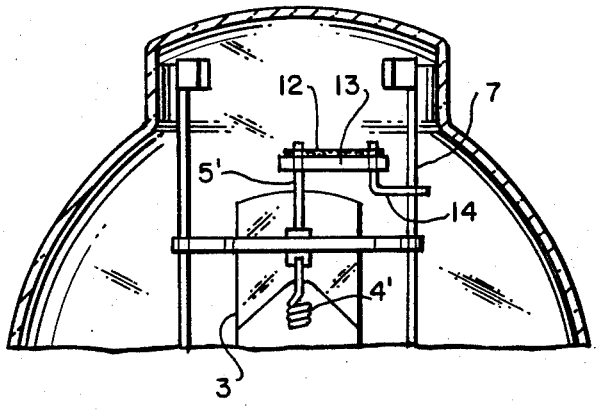

DISCHARGE LAMP WITH AUTOMATIC SHUT OFF

BACKGROUND OF THE INVENTION

The invention relates to high intensity discharge lamps, such as high pressure mercury vapor or metal halide lamps. In lamps of this type, the arc is produced in an inner discharge tube which is enclosed by an outer envelope made of a glass which is opaque to ultraviolet radiation produced by the lamp. If the outer envelope is broken, such lamps may constitute a health hazard since prolonged exposure to the ultraviolet radiation may cause burns, similar to intense sunburns, to the skin of people in the vicinity of the lamp.

Several approaches have been proposed for extinguishing the lamp when the outer envelope is ruptured. One such approach is to include a mechanical switch which opens and interrupts the supply of electrical power to the lamp upon rupture of the outer envelope. Such switches responded to either a change in the pressure within the outer envelope or are of the spring type which are held in the closed position by the outer envelope. The disadvantage of such arrangements is that it requires relatively complex and expensive mechanisms. Moreover, for proper operation of the spring type switch, the break in the outer envelope must occur at the location of the switch.

Another approach that has been proposed is to use a tungsten filament as a fusible safety link. Upon breakage of the outer envelope, the tungsten filament will oxidize and fail when it comes into contact with air. The disadvantage of this arrangement is that the tungsten filament must be maintained at a very high temperature of 1200° to 1800° C. during operation of the lamp. Such a tungsten fusible link, therefore, consumes an appreciable portion of the total power consumed by the lamp.

It is the object of the invention to provide a safety switch which extinguishes the lamp upon rupture of the outer envelope without the aforementioned disadvantages of the prior art construction.

SUMMARY OF THE INVENTION

In accordance with the invention, the discharge lamp comprises an arc tube supported within a hermetic outer envelope which is opaque to ultraviolet radiation. The arc tube is of conventional design and is provided with a pair of electrodes arranged at opposite ends of the tube. Each electrode is connected to a lead which passes through the wall of the arc tube and into the interior space between the arc tube and the outer envelope which may be either evacuated or filled with an inert gas. Conductor means connect each of the leads to means, such as a standard screw base, for connecting the lamp to a source of electrical power. One of the conductor means includes a carbon rod connected in series between the associated electrical lead and the connector means.

During operation the carbon rod is heated by the electrical current passing through it. Hence, if the carbon rod is exposed to air upon rupture of the outer envelope, it will oxidize to carbon dioxide and fail, interrupting the electrical path to the arc tube and extinguishing the lamp. The diameter and length of the carbon rod is selected in dependence on the wattage of the lamp so as to maintain the rod at a sufficient temperature to ensure oxidation in the event of breakage of the outer envelope.

BRIEF DESCRIPTION OF THE DRAWINGS

The invention will be described with the aid of the accompanying drawings in which:

FIG. 1 is a partly broken away view showing a high intensity discharge lamp embodying the present invention; and FIG. 2 is an enlarged fragmentary view showing another embodiment of the present invention.

DESCRIPTION OF THE PREFERRED EMBODIMENT

FIG. 1 shows a high-pressure mercury vapor discharge lamp having an outer envelope 1, a base 2 and an elongated arc tube 3. The outer envelope is made of a glass, such as a borosilicate glass, which transmits visible light but is opaque to ultraviolet radiation emitted by the arc tube. A pair of electrodes 4 and 4' are arranged at opposite ends of the tube 3. Each of the electrodes is connected to an electrical lead 5 and 5', respectively, which extends through the wall of the tube 3 and into the interior space 6. The space 6 between the outer envelope 1 and the arc tube 3 may be either evacuated or, as is usually the case with higher wattage lamps, filled with an inert gas such as nitrogen.

The arc tube 3 is supported within the envelope by a metallic wire frame 7 of conventional design. Leaf springs 8 at one end of the frame 7 engage the dome portion 9 of the outer envelope so as to resiliently maintain the arc tube centered within the outer envelope 1. The opposite end of the frame 7 is affixed to the lead 10 which electrically connects the frame to one of the terminals of the screw base 2. The electrode lead 5' is also electrically connected to the frame 7 so that the latter acts as an electrical conductor connecting the upper electrode 4' to the source of electrical power. The lead 5 from the other electrode 4 is connected to the second conductor 11 leading to the other terminal of screw base 2.

In accordance with the invention, the electrode 4' is connected to the frame 7 through a failsafe switch constituted by cylindrical carbon rod 12. The lead 5' from electrode 4' is a wire braid and is connected to one end of the carbon rod 12 by wrapping it tightly around the end of the rod and spot welding the braid to itself with some compression against the rod. The other end of the carbon rod is connected in like manner to a wire braid 14 which is spot welded to the frame 7. Conductive cement may be used to attach the carbon rod to the wire braids more securely and to aid electrical contact.

In operation, the carbon rod will be heated by the electrical current flowing through it. Hence, if the outer envelope is broken, the carbon rod will be exposed to air and oxidize rapidly to form carbon dioxide. The oxides are gaseous so that the rod will rapidly burn out and fail thereby interrupting the electrical path to electrode 4'.

The carbon rod may be graphite, carbon black or a mixture of the two with little or no binder. A suitable material for the rod is a pencil lead of the type which is nearly pure carbon. In the pencil lead of the preferred composition, the synthetic resin binder is partially or completely decomposed by heat treatment after extrusion so that the final result is mainly graphite and carbon black. An example of such material is pencil lead manufactured by the Pentel Corporation. Pencil leads which use clay as a binder are less suitable for use as failsafe switches since upon oxidation of the surface layer, a clay coating is left which hinders oxidation of the remaining carbon.

The dimensions of the rod depend on the wattage of the lamp. For oxidation to occur upon exposure to air, the carbon rod should be maintained at a temperature of at least 400° C. and preferably at about 600° C. Accordingly, the rod should be dimensioned so that at the rated lamp current, the rod is heated to a temperature which will result in oxidation and burn-out upon rupture of the outer envelope. It has been found that for a 25 to 30 mm long rod, the diameter should vary with lamp wattage as follows:

1000 W—0.9 mm diameter
700 W, 400 W—0.5 mm diameter
175 W, 250 W—0.3 mm diameter In the case of 400 W mercury and metal halide lamps, a 0.5 mm diameter pencil lead having a length from 30 to 60 mm performs satisfactorily. At room temperature, a 0.5 mm diameter and 30 mm long carbon rod has a resistance of about 0.8 Ohms. During operation of the 400 W lamp, the carbon rod exhibited a dark red glow indicating that it is maintained at a temperature of approximately 600° C. The burn out time of a switch of these dimensions is 5 to 6 minutes. For a 0.5 mm diameter, 60 mm long carbon rod, the burn-out time decreases to approximately 2 to 3 minutes.

For protection against breakage due to shocks during handling, shipping and the like, the carbon rod may be secured to a rod of glass or other suitable non-conductive material. In the embodiment shown in FIG. 2, the leads 5' and 14 are medium diameter wires, for example, 0.025 inch molybdenum wires. The two wires are sealed into a glass rod 13 by heating the ends of the glass rod and pressing the wires into the molten glass. The ends of the two wires protruding from the glass rod are provided with loops and the carbon rod 12 is cemented into the loops with conductive cement. A conductive cement suitable for this purpose is Aremco-coat 543.

Instead of sealing the wires in the glass rod, wire braids may be used which are attached to the glass rod 13 by tightly wrapping them about the ends of the glass rod and spot welding the braid to itself. The carbon rod is then attached to the braid at each end of the glass rod by conductive cement or, alternatively, by a second wire braid which is wrapped around the first braid and spot welded to it so that the carbon rod 12 is sandwiched between the two wire straps. One advantage of this arrangement is that the carbon rod 12 is spaced from the glass rod 13 by the thickness of the wire braid so that thermal losses from this carbon rod are reduced.

What is claimed is:

1. A discharge lamp comprising a hermetic outer envelope which is opaque to short wavelength ultraviolet radiation, an arc tube disposed within and enclosed by said outer envelope, said arc tube and said outer envelope defining an interior space therebetween which is substantially devoid of oxygen, a pair of spaced apart electrodes arranged at opposite ends of said arc tube, a pair of electrical leads each connected to a respective one of said electrodes and extending through said arc tube into said interior space, means arranged on the exterior of said outer envelope for connecting the lamp to a source of electrical power, a pair of conductor means disposed in said interior space and each electrically connecting a respective one of said leads to said connecting means, one of said conductor means including a carbon element connected in series between the associated electrical lead and said connecting means, a non-conductive cylindrical rod, means for supporting said non-conductive rod in said interior space and means for securing said carbon element to said non-conductive rod so as to protect said carbon element from breakage due to shocks and vibration during handling and the like, said carbon element being formed of a length of pencil lead comprised of graphite and having dimensions such that during operation of the lamp electrical current passing therethrough maintains said carbon element at a temperature such that upon breakage of said outer envelope and exposure of said element to air, said carbon element oxidizes and ruptures thereby extinguishing the lamp by interrupting the electrical path between said connecting means and said associated electrode.

2. The lamp according to claim 1 wherein said non-conductive rod is a glass rod, said associated lead is a wire sealed into one end of said glass rod and said one conductor means includes a second wire sealed in the other end of said glass rod, said wires being electrically connected to opposite ends of said carbon element.

3. The lamp according to claim 1 wherein said associated lead is a wire braid which is wrapped around one end of said non-conductive rod and welded to itself and said one conductor means includes a wire braid which is wrapped around the other end of said non-conducting rod and welded to itself, each end of said carbon element being electrically connected to a respective one of said wire braids.

4. A discharge lamp comprising a hermetic outer envelope which is opaque to short wavelength ultraviolet radiation, an arc tube disposed within and enclosed by said outer envelope, said arc tube and said outer envelope defining an interior space therebetween which is substantially devoid of oxygen, a pair of spaced apart electrodes arranged at opposite ends of said arc tube, a pair of electrical leads each connected to a respective one of said electrodes and extending through said arc tube into said interior space, means arranged on the exterior of said outer envelope for connecting the lamp to a source of electrical power, a pair of conductor means disposed in said interior space and each electrically connecting a respective one of said leads to said connecting means, one of said conductor means including a carbon element connected in series between the associated electrical lead and said connecting means, a cylindrical glass rod, said associated lead comprising a wire sealed into one end of said glass rod, and said one conductor means comprising a second wire sealed in the other end of said glass rod, said wires being electrically connected to opposite ends of said carbon element so that said glass rod is supported in said interior space and said carbon element is secured to said rod so as to protect said carbon element from breakage due to shocks and vibration during handling and the like, said carbon element having dimensions such that during operation of the lamp electrical current passing therethrough maintains said carbon element at a temperature such that upon breakage of said outer envelope and exposure of said element to air, said carbon element oxidizes and ruptures thereby extinguishing the lamp by interrupting the electrical path between said connecting means and said associated electrode.

5. The lamp according to claim 4 wherein said carbon element is a cylindrical, carbon rod.

6. The lamp according to claim 5 wherein said carbon rod is comprised of graphite.

7. The lamp according to claim 6 wherein said rod is a pencil lead.

8. A discharge lamp comprising a hermetic outer envelope which is opaque to short wavelength ultraviolet radiation, an arc tube disposed within and enclosed by said outer envelope, said arc tube and said outer envelope defining an interior space therebetween which is substantially devoid of oxygen, a pair of spaced apart electrodes arranged at opposite ends of said arc tube, a pair of electrical leads each connected to a respective one of said electrodes and extending through said arc tube into said interior space, means arranged on the exterior of said outer envelope for connecting the lamp to a source of electrical power, a pair of conductor means disposed in said interior space and each electrically connecting a respective one of said leads to said connecting means, one of said conductor means including a carbon element connected in series between the associated electrical lead and said connecting means, a non-conductive, cylindrical rod, said associated lead comprising a wire braid which is wrapped around one end of said rod and welded to itself, and said one conductor means comprising a second wire braid which is wrapped around the other end of said rod and welded to itself, each end of said carbon element being electrically connected to a respective one of said wire braids so that said rod is supported in said interior space and said carbon element is secured to said rod so as to protect said carbon element from breakage due to shocks and vibration during handling and the like, said carbon element having dimensions such that during operation of the lamp electrical current passing therethrough maintains said carbon element at a temperature such that upon breakage of said outer envelope and exposure of said element to air, said carbon element oxidizes and ruptures thereby extinguishing the lamp by interrupting the electrical path between said connecting means and said associated electrode.

9. The lamp according to claim 8 wherein said carbon element is a cylindrical, carbon rod.

10. The lamp according to claim 9 wherein said carbon rod is comprised of graphite.

11. The lamp according to claim 10 wherein said rod is a pencil lead.

* * * * *